United States Patent [19]

Rangfors

[11] Patent Number: 4,675,910

[45] Date of Patent: Jun. 23, 1987

[54] BAG HAVING STRING-SHAPED SUSPENDING ELEMENT

[76] Inventor: Gösta Rangfors, Lavendelvägen 22, S-237 00 Bjärred, Sweden

[21] Appl. No.: 848,331

[22] Filed: Apr. 3, 1986

Related U.S. Application Data

[63] Continuation of Ser. No. 555,468, Nov. 28, 1983, abandoned.

[30] Foreign Application Priority Data

Nov. 30, 1982 [SE] Sweden ..... 8206823
Nov. 14, 1983 [SE] Sweden ..... 8306239

[51] Int. Cl.[4] ..... B65D 33/14
[52] U.S. Cl. ..... 383/19; 383/70
[58] Field of Search ..... 383/19, 70, 71, 7

[56] References Cited

U.S. PATENT DOCUMENTS

| | | | |
|---|---|---|---|
| 2,672,902 | 3/1954 | Prager | 383/19 |
| 3,028,897 | 4/1962 | Gooding . | |
| 3,317,119 | 5/1967 | Lasoff | 383/70 |
| 3,422,985 | 1/1969 | Rinehart | 383/70 |
| 3,973,609 | 8/1976 | Lofberg | 383/19 |
| 4,222,422 | 9/1980 | Lofberg | 383/19 |
| 4,253,507 | 3/1981 | Williamson | 383/71 |

FOREIGN PATENT DOCUMENTS

| | | | |
|---|---|---|---|
| 85505 | 5/1958 | Denmark | 383/71 |
| 477262 | 1/1928 | Fed. Rep. of Germany . | |
| 1021478 | 12/1952 | France | 383/70 |
| 1158237 | 6/1958 | France . | |
| 135032 | 2/1977 | Sweden . | |
| 7600295 | 6/1977 | Sweden . | |
| 7807730 | 2/1980 | Sweden . | |

*Primary Examiner*—Stephen P. Garbe
*Attorney, Agent, or Firm*—Harness, Dickey & Pierce

[57] ABSTRACT

A package and a method of manufacturing the package. The package is the type of sack known as a bulk bag comprising an outer cover provided with a liquid-tight liner. Through the interior of the bag extends a string-shaped member in the form of a rope which is tied by means of a knot to the welded-together bottom portion of the bag. The upper portion of the bag is gathered about the rope to form a package-handling member in the shape of a loop. The cover is welded together also at its upper end in order to prevent penetration of liquid into the bag interior. The bag is provided with a filler valve.

6 Claims, 4 Drawing Figures

BAG HAVING STRING-SHAPED SUSPENDING ELEMENT

This application is a continuation of application Ser. No. 555,468, filed Nov. 28, 1983, now abandoned.

BACKGROUND OF THE INVENTION

The subject invention concerns a package of the kind comprising a bag-like cover and a string-shaped member which is attached to the bottom part of the package and extends through the package interior. The invention also concerns a method of manufacturing said package.

Packages of the kind described above, usually referred to as bulk bags, are previously known and are described for instance in SE No. 412 055 and SE No. 391 695. The packages disclosed in these prior publications consist of two covers, one of which is fitted into the other. The string-shaped member consists of a rope which is passed through a retainer element in the gathered upper part of the outer cover and which is provided with a knot immediately interiorly of the upper gathered part of the cover. The rope forms a U-shaped hook member on the outside of the package and projects and penetrates into the package interior through a further opening in the upper part of the cover and is attached to the bottom of the package. The rope is passed through a retainer element provided at the package bottom and a knot is formed thereon on the bottom face of the retainer element. Along its extension through the package interior the rope is enclosed in a protective hose to prevent liquid from entering into the package interior via the rope and coming into contact with the contents in the bag, as such contents may consist of materials of a kind which are spoiled upon their contact with water, such as is the case with cement, for example. The difficulties experienced in such prior-art packages in obtaining completely water-sealed rope entrances obviously are a considerable drawback.

Another disadvantage found in this prior-art package construction is that it is not adapted to rational and automized production. This is due to the necessity of providing knots on the rope and of providing the package with retainer elements, which elements may be in the form of clamps or smaller ropes. Also the protective hose enclosing the rope makes the adaption of the package to rational manufacturing methods difficult.

The packages manufactured in accordance with the prior-art techniques are lifted by the U-shaped hook member formed by the rope. The lifting force is transferred to the points of attachment of the rope to the package cover, exposing these points to exceptionally high load stress.

SUMMARY OF THE INVENTION

One purpose of the subject invention is to provide a package in which the risk of leakage of liquid into the package interior is entirely eliminated. In consequence thereof, the protective hose required in the bags of prior-art designs becomes entirely superfluous.

Another purpose of the subject invention is to provide a package possessing such properties as ensure that when the package is lifted the lifting forces are distributed in an optimally advantageous manner between the rope and the package cover.

Yet another purpose of the subject invention is to provide a package which lends itself to rationalized and mechanized production.

Each one of the purposes thus outlined is achieved in accordance with the subject invention in a package which is simple, reliable in use and cheap to manufacture. The package is characterised in that the string-shaped member is arranged to form, together with the upper portion of the package cover, a member to be used to lift and handle the package. Further characteristics of the package in accordance with the invention will appear from the dependent claims attached hereto.

The method of producing the package in accordance with the subject invention, which package is of the type comprising a string-shaped member which extends through the package interior and is attached to the bottom portion of said package is characterised by the steps of cutting a hose-shaped starting blank into bag blanks, sealing said blanks at one of their ends, tying said string-shaped member to said end, providing a filler opening in the bag blank, turning said bag blank inside out, whereby said string-shaped member will be positioned in the bag interior, and gathering the portion of the bag blank which is opposite the bottom portion about the string-shaped member so that the latter, together with the string-shaped member, forms a hook element.

Additional features of producing the package in accordance with the invention will appear from the dependent method claims.

BRIEF DESCRIPTION OF THE DRAWINGS

The invention will be described in closer detail in the following with reference to the accompanying drawings, wherein.

DETAILED DESCRIPTION OF THE DRAWINGS

Figure 1:
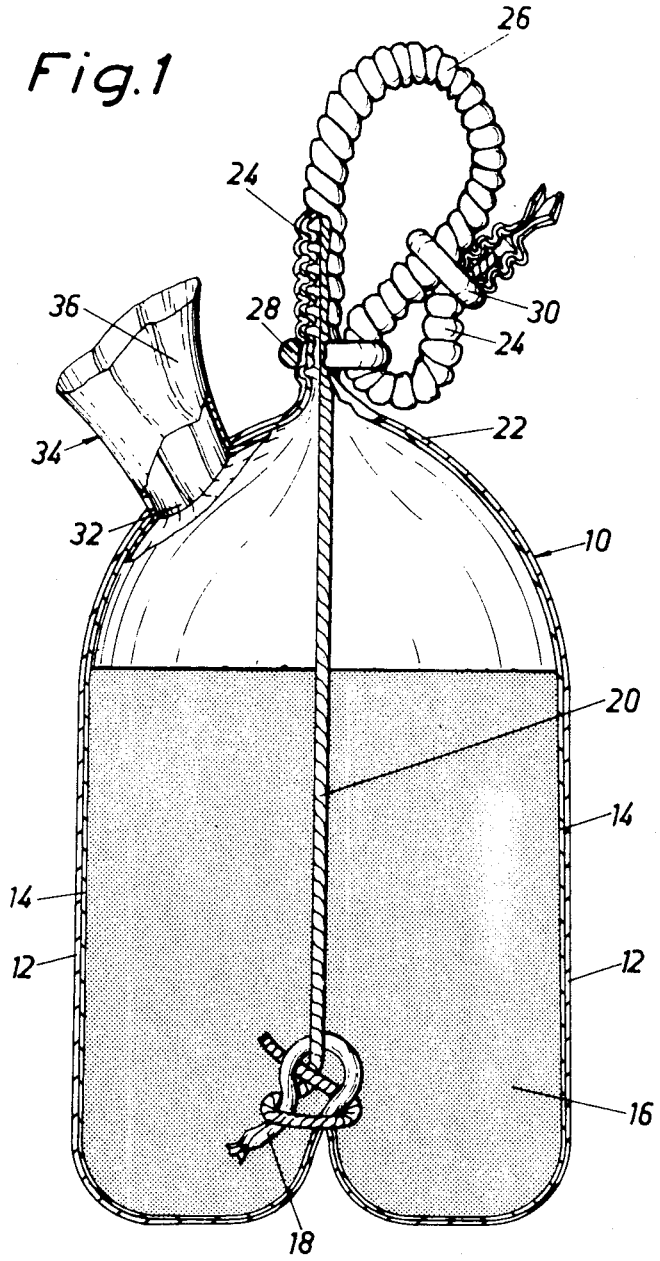
FIG. 1 is a cross-sectional view through a package in accordance with the invention, the package being shown in its filled condition.

As appears from FIG. 1 the package in accordance with the invention is a sack of the type known as a bulk bag 10 which is intended to serve as a throwaway package to transport granular or powdered products. The walls of the bag 10 consist of an outer cover 12 of sacking or the like of natural or synthetic fibres, the inner face of said cover being provided with an inner coat in the form of a liner 14. The latter consists of a liquid-impervious material, preferably a weldable plastics material, thus ensuring protection of the load 16 to be transported inside the bag 10 against moisture and liquid.

The bag 10 is closed together at its bottom portion 18 by welding. To the bottom portion 18 is tied a string-shaped member which consists of a rope 20 extending through the interior of the bag, through the load 16 and up to the upper portion 22 of the bag 10.

The cover 12, 14 of the bag 10 is gathered at the upper portion 22 of the bag about the rope 20 into a narrow end part 24, which narrow part is shaped into a hook member in the form of a loop 26. The gathering of the cover about the rope may be effected in any one of a number of convenient ways such as by twisting or pressing, to mention a few. The loop 26 is held in position by means of a ring 28. A second ring 30 is provided and positioned so as to secure the outer end portion of the narrow end part 24. The cover 12, 14 is sealed by welding at this outer end portion in order to prevent liquid from leaking into the bag interior via the rope 20.

The bag 10 is provided with a filler opening 32 at its upper portion. In the opening is positioned a filler valve 34. The valve is preferably welded to the liner 14 and comprises a funnel-like portion 36 which is pulled outwards through the opening 32. When the filling of the bag is completed the value 34 may be closed from the outside of the bag 10 and then be re-inserted into the bag 10 for protection.

The bag in accordance with the subject invention is emptied in the same manner as prior art bulk bags.

The loop 26 forms a hook member by means of which the bag 10 may be lifted and handled. During lifting and handling of the bag the lifting force is taken both by the rope 20 and is transferred by the latter to the bottom of the bag, and by the upper portion of the cover 12, 14 and is transferred by the latter to the side walls of the bag 10. This means that the bag bottom as well as its side walls will take the load, since the upper mass of the granulate or powdered material inside the bag will have a tendency to "slide" on the lower mass of the goods and consequently exert an essentially horizontal pressure load on the side walls of the bag 10.

Figure 2:
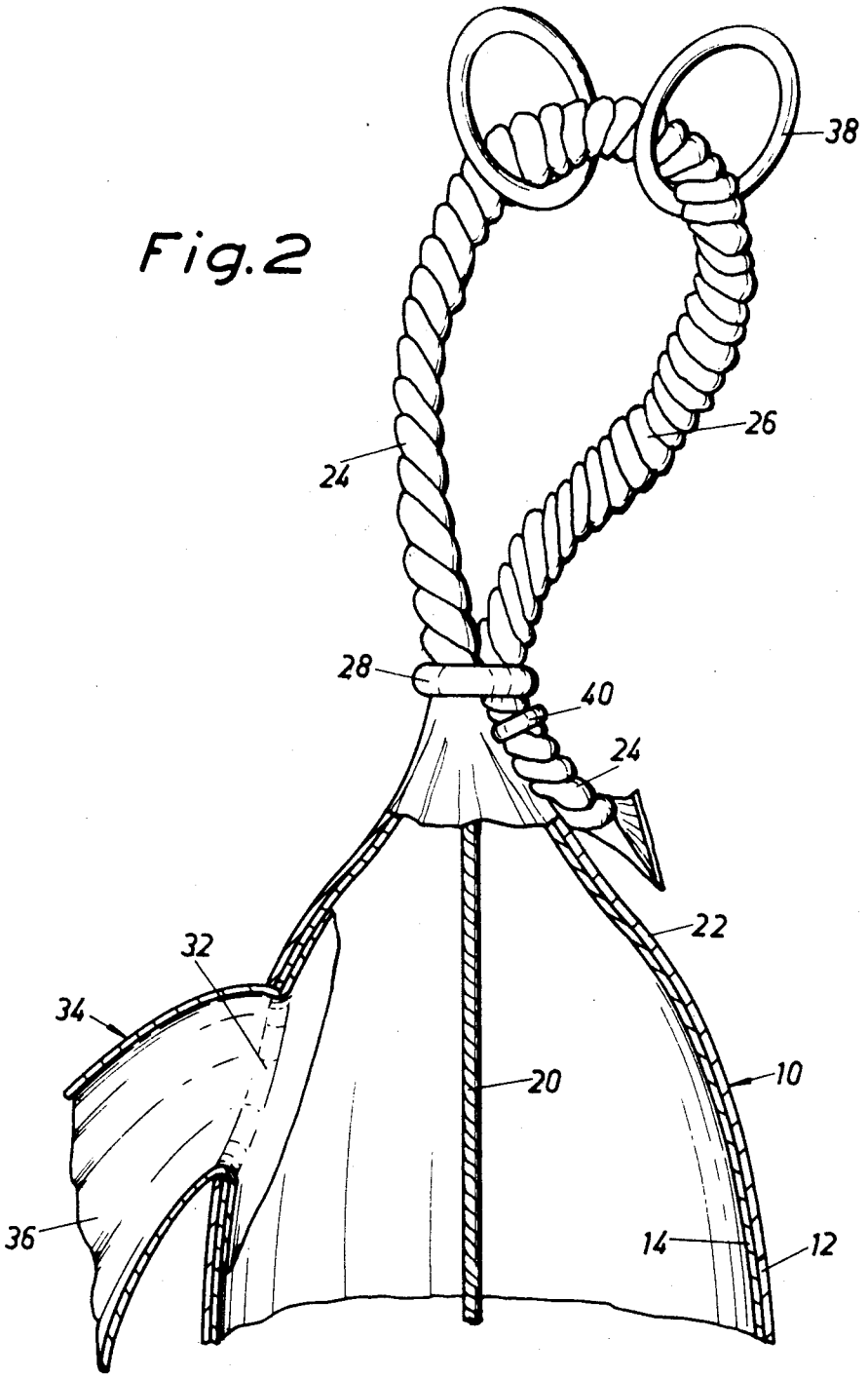
FIG. 2 is a partly broken view, shown on an enlarged scale, of the upper portion of the package.

FIG. 2 shows a somewhat modified embodiment of the lifting loop 26. In this case the loop is provided with two lifting rings 38 in which a lifting means (not shown) may be attached. On the outer end portion of the narrow end part 24 is mounted a locking ring 40 to prevent the end portion from sliding through the ring 28.

Figure 3:
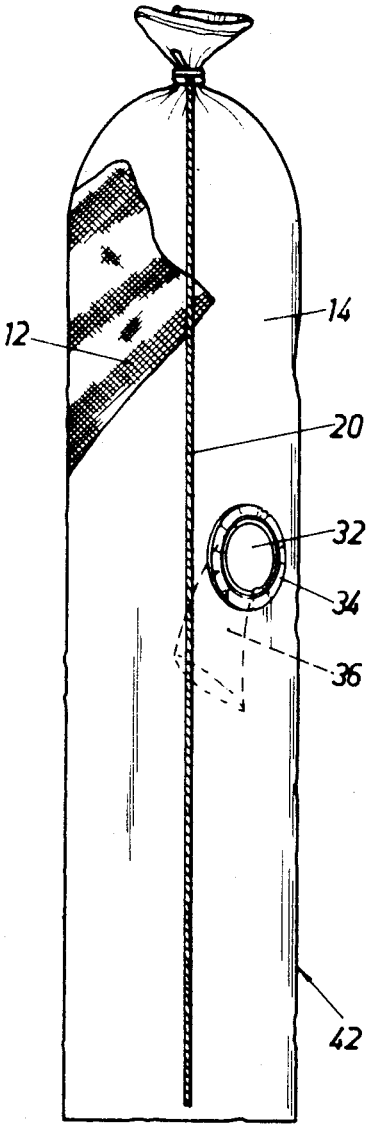
FIGS. 3 and 4 are views showing the principles of manufacturing the package in accordance with the method of the subject invention.

The package (bulk bag 10) in accordance with the subject invention is manufactured in the following manner. The starting material is a hose-like blank of a suitable material, preferably a woven or knitted material, which is to form the outer cover 12 of the bag 10. The outer cover is coated in any suitable manner such as by spraying, brushing or other application technique, with a weldable liquid-proof plastics material which forms the liner 14. The hose blank is cut into bag blanks 42. One end of the blank is closed by welding (forming the bottom of the future bag). The string-shaped member, that is, the rope 20, is tied to this end. The filler opening 32 is formed in the cover 12, 14 and the filler valve 34 is welded to the opening, the funnel-shaped part 36 of the valve extending into the bag blank 42 (see FIG. 3).

Figure 4:
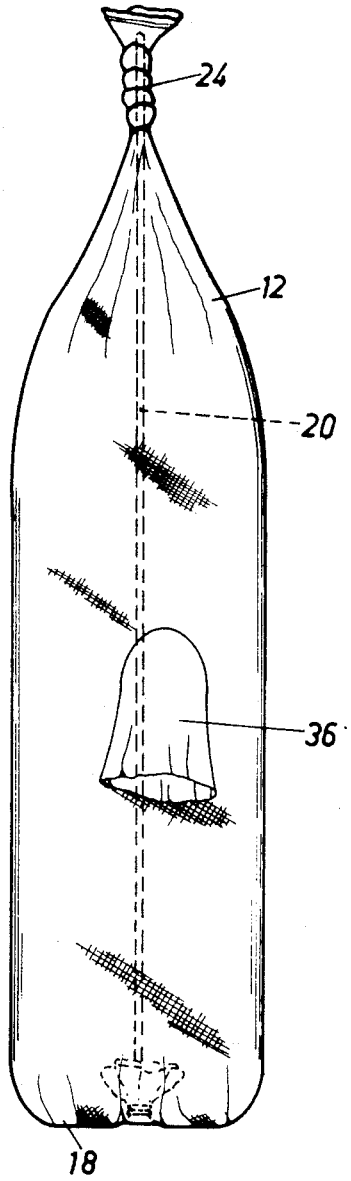

The bag blank 42 is turned inside out, whereby the rope 20 will extend through the blank interior towards the opening at the end opposite the bottom portion 18. This opening is closed by welding and the cover 12, 14 is gathered about the rope 20 to form the narrow end part 24 (see FIG. 4). The latter is secured in position by means of the ring 28 to form the loop 26.

The embodiment of the invention described above is to be regarded as an example only and a number of modifications are possible within the scope of the appended claims.

In some applications of the bag in accordance with the subject invention it is not necessary to use a liner 14 which is impervious to liquid. In such cases, the liner made from a liquid-proof material is not applied to the hose blank. It is of course not then possible to weld together the hose blank ends but instead the bag openings are stitched together at the top and bottom. Also the filler valve 34 must be stitched to the bag.

Instead of a rope 20, the string-shaped member may be a wire, a sling, a chain or a similar means.

As an alternative, the liner 14, instead of being a coating, could be a separate lining which is arranged about the bag blank 42 during the manufacturing process and is tied to the blank by means of the rope 20 at the blank and which will form the bottom part of the finished bag. This separate lining could be provided with a filler opening corresponding to filler opening 32 and is turned inside out together with the bag blank and is secured to the upper portion 22 of the bag 10, preferably by being gathered together with the outer cover 14 about the rope to form the narrow end part 24.

What I claim is:

1. An improved package of the type comprising a bag-shaped cover and a string-shaped member, said string-shaped member extending into the package interior through an upper portion of said cover and being secured at one end of said string-shaped member to the bottom portion of said cover, the improvement comprising a portion of said string-shaped member extending through said cover upper portion and being surrounded by said cover upper portion, said cover upper portion comprising a narrow end part, said narrow end part being formed by gathering that part of the cover upper portion about said string-shaped member, said cover upper portion and said portion of said string-shaped member being thus affixed together for forming a lifting portion to lift and handle said package with lifting loads being transferred directly to the upper portion of said cover by said cover upper portion and to the lower portion of said cover by said string-shaped member one end, said cover upper portion extending beyond the other end of the string-shaped member and being sealed for totally enclosing said string-shaped member within said package cover.

2. An improved package as claimed in claim 1, wherein said narrow end part is shaped into a loop.

3. An improved package as claimed in claim 2, comprising a ring, said ring arranged on said loop to maintain said loop in position.

4. An improved package as claimed in claim 1, wherein said string-shaped member is a rope.

5. An improved package as claimed in claim 1, wherein said cover comprises an outer cover and a separate lining.

6. An improved package as set forth in claim 1 further including a filling opening formed in the cover at a point spaced from the cover upper portion and fill valve means for opening and closing said filling opening.

* * * * *